US005224462A

United States Patent [19]

Orzel

[11] Patent Number: 5,224,462

[45] Date of Patent: Jul. 6, 1993

[54] AIR/FUEL RATIO CONTROL SYSTEM FOR AN INTERNAL COMBUSTION ENGINE

[75] Inventor: Daniel V. Orzel, Westland, Mich.

[73] Assignee: Ford Motor Company, Dearborn, Mich.

[21] Appl. No.: 937,008

[22] Filed: Aug. 31, 1992

[51] Int. Cl.[5] ..... F02M 25/08; F02D 41/14

[52] U.S. Cl. ..... 123/696; 123/698

[58] Field of Search ..... 123/490, 520, 696, 698

[56] References Cited

U.S. PATENT DOCUMENTS

| | | | |
|---|---|---|---|
| 4,196,702 | 4/1980 | Bowler | 123/490 X |
| 4,467,769 | 8/1984 | Matsumura | 123/674 |
| 4,532,907 | 8/1985 | Buglione et al. | 123/490 |
| 4,586,478 | 5/1986 | Nogami et al. | 123/682 |
| 4,641,623 | 2/1987 | Hamburg | 123/518 |
| 4,677,956 | 7/1987 | Hamburg | 123/520 |
| 4,715,340 | 12/1987 | Cook et al. | 123/406 |
| 4,741,318 | 5/1988 | Kortge et al. | 123/520 |
| 4,748,959 | 6/1988 | Cook et al. | 123/520 |
| 4,763,634 | 8/1988 | Morozumi | 123/520 |
| 4,841,940 | 6/1989 | Uraniski et al. | 123/694 |
| 4,865,000 | 9/1989 | Yajima | 123/520 |
| 4,867,126 | 9/1989 | Yonekawa et al. | 123/520 |
| 4,932,386 | 6/1990 | Uozumi et al. | 123/520 |
| 4,961,412 | 10/1990 | Furuyama | 123/520 |
| 4,967,713 | 11/1990 | Kojima | 123/696 |
| 5,048,492 | 9/1991 | Davenport et al. | 123/674 |
| 5,048,493 | 9/1991 | Orzel et al. | 123/674 |
| 5,090,388 | 2/1992 | Hamburg et al. | 123/674 |

*Primary Examiner*—Tony M. Argenbright

*Attorney, Agent, or Firm*—Allan J. Lippa; Roger L. May

[57] ABSTRACT

A control system (10) controls the induction of fuel injected into an internal combustion engine (14) to achieve stoichiometric combustion. The control system includes a feedback controller (32) which generates a feedback variable by integrating the output of an exhaust gas oxygen sensor (26). Integration is inhibited in response to an indication of a rich air/fuel offset.

10 Claims, 4 Drawing Sheets

AIR/FUEL RATIO CONTROL SYSTEM FOR AN INTERNAL COMBUSTION ENGINE

BACKGROUND OF THE INVENTION

The field of the invention relates to control systems responsive to an exhaust gas oxygen sensor for maintaining an engine's air/fuel ratio at stoichiometric combustion.

U.S. Pat. No. 4,867,126 issued to Kortge et al discloses an engine having a fuel vapor recovery system coupled between a fuel system and engine air/fuel intake. A feedback control system generates a feedback variable by integrating the output of an exhaust gas oxygen sensor. Liquid fuel injected into the engine is trimmed in response to the feedback variable in an attempt to maintain stoichiometric combustion. When the feedback variable exceeds a predetermined value, the induction of recovered fuel vapors is reduced to, allegedly, maintain operation within the feedback system's range of authority.

The inventors herein have recognized several problems with the above approach. Even when the rate of vapor flow is reduced to zero, there are certain engine operating conditions where the feedback system will induce an air/fuel transient. During engine deceleration, for example, the low rate of air induction may result in rich operation because the fuel injectors are operating below their linear range. That is, the fuel injectors will deliver more fuel than demanded when the actuating electrical pulse width is below a critical pulse width. The engine will continue to operate rich during deceleration and the feedback variable will continue to provide a lean correction without effect. When the engine throttle is restored, the lean correction provided by the feedback variable will then cause operation lean of stoichiometry resulting in engine "stumble".

SUMMARY OF THE INVENTION

An object of the invention herein is to eliminate air/fuel transients induced by the air/fuel ratio feedback control system.

The above object and others are achieved, and problems of prior approaches overcome, by providing both a control system and method for controlling air/fuel operation of a fuel injected engine. In one particular aspect of the invention, the control system comprises: feedback control means for providing a feedback signal by integrating a signal responsive to an exhaust gas oxygen sensor coupled to the engine exhaust; actuation means for providing an actuating signal to one or more of the fuel injectors with a pulse width related to the feedback signal; and inhibiting means for inhibiting integration of the signal by the feedback control means when the pulse width is less than a predetermined pulse width.

An advantage obtained by the above aspect of the invention over prior approaches is that a lean correction from the air/fuel feedback control system is inhibited which would otherwise induce a lean air/fuel transient and possible engine stumble.

BRIEF DESCRIPTION OF THE DRAWINGS

The object and advantages of the invention claimed herein and others will be more clearly understood by reading an example of an embodiment in which the invention is used to advantage, referred to herein as the Preferred Embodiment, with reference to the attached drawings wherein:

DESCRIPTION OF THE PREFERRED EMBODIMENT

Figure 1:
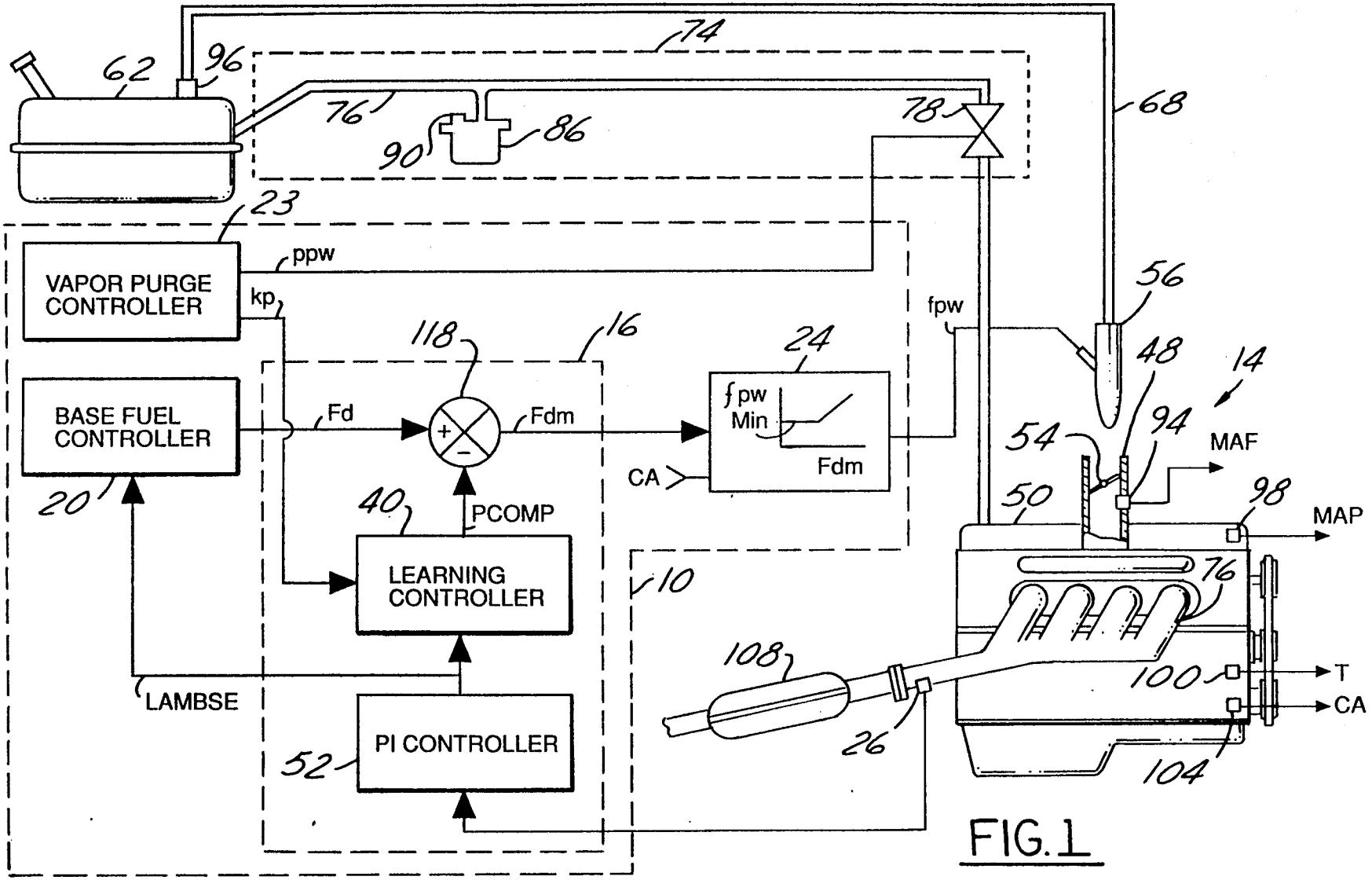
FIG. 1 is a block diagram of an embodiment wherein the invention is used to advantage.

Referring first to FIG. 1, control system or controller 10 is here shown controlling delivery of both liquid fuel and recovered or purged fuel vapor to engine 14. As described in greater detail later herein, controller 10 is shown including feedback control system 16, base fuel controller 20, fuel controller 24, and vapor purge controller 28. Feedback control system 16 is shown including PI controller 32 and learning controller 40. PI controller 32 is a proportional plus integral controller, in this particular example, which generates feedback correction value LAMBSE responsive to exhaust gas oxygen sensor (EGO) 36. Learning controller 40 generates purge compensation feedback variable PCOMP which is representative of the mass flow rate of purged fuel vapors inducted into engine 14.

Engine 14 is shown as a central fuel injected engine having throttle body 48 coupled to intake manifold 50. Fuel injector 56 injects a predetermined amount of fuel into throttle body 48 during the pulse width of actuating signal fpw provided by controller 24 as described in greater detail later herein. Fuel is delivered to fuel injector 56 by a conventional fuel system including fuel tank 62, fuel pump 66, and fuel rail 68.

Fuel vapor recovery system 74 is shown coupled between fuel tank 62 and intake manifold 50 via electronically actuated purge control valve 78. In this particular example, the cross sectional area of purge control valve 78 is determined by the duty cycle of actuating signal ppw from purge controller 28 in a conventional manner. Fuel vapor recovery system 74 includes canister 86 connected in parallel to fuel tank 62 for absorbing fuel vapors therefrom by activated charcoal contained within the canister.

During fuel vapor recovery, commonly referred to as vapor purge, air is drawn through canister 86 via inlet vent 90 absorbing hydrocarbons from the activated charcoal. The mixture of air and recovered fuel vapors is then inducted into manifold 50 via purge control valve 78. Concurrently, recovered fuel vapors from fuel tank 62 are drawn into intake manifold 50 through valve 78. Accordingly, a mixture of purged air and recovered fuel vapors from both fuel tank 62 and canister 86 are purged into engine 14 by fuel vapor recovery system 74 during purge operations.

Conventional sensors are shown coupled to engine 14 for providing indications of engine operation. In this example, the sensors include: mass air flow sensor 94 providing a measurement of mass air flow (MAF) inducted into engine 14; manifold pressure sensor 98 providing a measurement (MAP) of absolute manifold pressure in intake manifold 50; temperature sensor 70 providing a measurement of engine operating temperature (T); engine speed sensor 104 providing a measurement of engine speed (rpm) and crank angle (CA).

Engine 14 also includes exhaust manifold 106 coupled to conventional three-way ($NO_x$,CO,HC) catalytic convertor 108. EGO sensor 26, a conventional two-state oxygen sensor in this example, is shown coupled to exhaust manifold 106 for providing an indication of air/fuel ratio operation of engine 14. EGO sensor 26 provides an output signal having a high state when air/fuel operation is at the rich side of reference or desired air/fuel ratio $A/F_D$. In this particular example, $A/F_D$ is selected for stoichiometric combustion (14.7 lbs. air/1 lb. fuel). When engine air/fuel operation is lean of stoichiometry, EGO sensor 26 provides its output signal at a low state.

Base fuel controller 20 provides desired fuel charge signal Fd by dividing signal MAF by both feedback value LAMBSE and desired air/fuel ratio $A/F_D$ as shown by the following.

$$Fd = \frac{MAF}{(A/F_D)\ LAMBSE}$$

Desired fuel charge signal Fd is then reduced by the quantity of fuel supplied by recovered fuel vapors (i.e., purge compensation signal PCOMP) in subtracter 118 to generate modified desired fuel charge signal Fdm. Fuel controller 24 converts signal Fdm into fuel pulse width signal fpw with an "on" time or pulse width which actuates fuel injector 56 for the time period required to deliver the desired quantity of fuel.

In this particular example, fuel controller 24 is a look-up table addressed by signal Fdm. In the schematic representation of this look-up table shown in FIG. 1, signal Fdm is shown linearly related to signal fpw. Fuel pulse width signal fpw is shown clipped at the minimum pulse of the linear operating range of fuel injector 56. If fuel injector 56 was actuated with a pulse width less than this minimum value, the fuel delivered therethrough may not be linearly related to actuating pulse width and accurate air/fuel control may not be maintained by controller 10. In addition, the fuel atomization may be degraded at actuating pulse widths less than the minimum pulse width.

Figure 2:
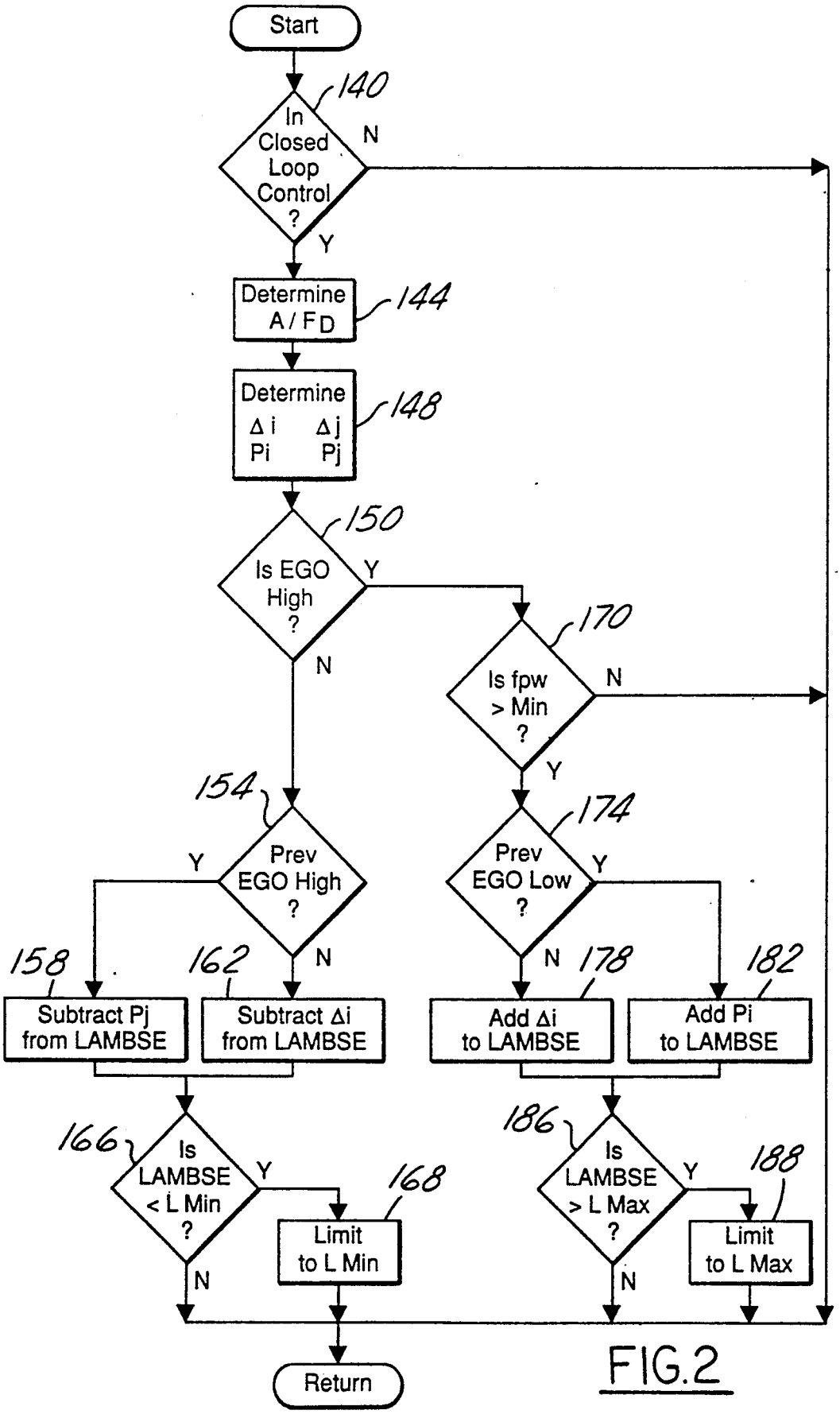
FIG. 2 is a high level flowchart illustrating steps performed by a portion of the embodiment illustrated in FIG. 1.

Operation of PI controller 32, is now described with reference to the flowchart shown in FIG. 2 and continuing reference to FIG. 1. After a determination is made that closed loop (i.e., feedback) air/fuel control is desired in step 140, desired air/fuel ratio ($A/F_D$) is determined in step 144. The proportional terms (Pi and Pj) and integral terms (Δi and Δj) are then determined in step 148 to achieve an air/fuel operation which averages at $A/F_D$.

EGO sensor 26 is sampled in step 150 during each background loop of the microprocessor. When EGO sensor 26 is low (i.e., lean), but was high (i.e., rich) during the previous background loop (step 154), proportional term Pj is subtracted from LAMBSE in step 158. When EGO sensor 26 is low, and was also low during the previous background loop, integral term Δj is subtracted from LAMBSE in step 162. Accordingly, in this particular example of operation, proportional term Pj represents a predetermined rich correction which is applied when EGO sensor 26 switches from rich to lean. Integral term Δj represents an integration step to provide continuously increasing rich fuel delivery while EGO sensor 26 continues to indicate combustion lean of stoichiometry.

After LAMBSE has been decreased to provide a rich fuel correction (steps 158 or 162), LAMBSE is compared to its minimum value (LMin) in step 166. LMin corresponds to the lower limit of the operating range of authority of PI controller 32. When LAMBSE is less than LMin, it is limited to this value in step 168.

Operation of PI controller 32 is now described under circumstances when EGO sensor 26 is high (step 150) and fuel pulse width signal fpw greater than its minimum value (step 170). When EGO sensor 26 is high, but was low during the previous background loop (step 174), proportional term Pi is added to LAMBSE in step 182. When EGO sensor 26 is high, and was also high during the previous background loop, integral term Δi is added to LAMBSE in step 178. Proportional term Pi represents a proportional correction in a direction to decrease fuel delivery when EGO sensor 26 switches from lean to rich, and integral term Δj represents an integration step in a fuel decreasing direction while EGO sensor 26 continues to indicate combustion rich of stoichiometry.

During step 186, after LAMBSE has been corrected in a fuel decreasing direction (step 178 or 182), LAMBSE is compared to its maximum value (LMax) which corresponds to the upper limit of the operating range of authority of PI controller 32. When LAMBSE is greater than LMax, it is limited to this value in step 168.

Referring back to steps 150 and 170, when EGO sensor 26 indicates combustion rich of stoichiometry and fuel pulse width signal fpw is less than its minimum value, LAMBSE is not incremented and the program is exited. Accordingly, PI controller 32 is inhibited from providing further air/fuel corrections in the lean or fuel decreasing direction when fuel pulse width signal fpw is less than its minimum value. Without so inhibiting LAMBSE, desired fuel charge signal Fd would be reduced even though fuel injector 56 may be unable to deliver the lower fuel quantity demanded. When fuel pulse width signal fpw is subsequently increased above its minimum value, such as at the end of a vehicular deceleration, the incremented value of LAMBSE would result in continued lean correction and engine stumble. This and similar occurrences are prevented by inhibiting LAMBSE in the manner described above.

Figure 3:
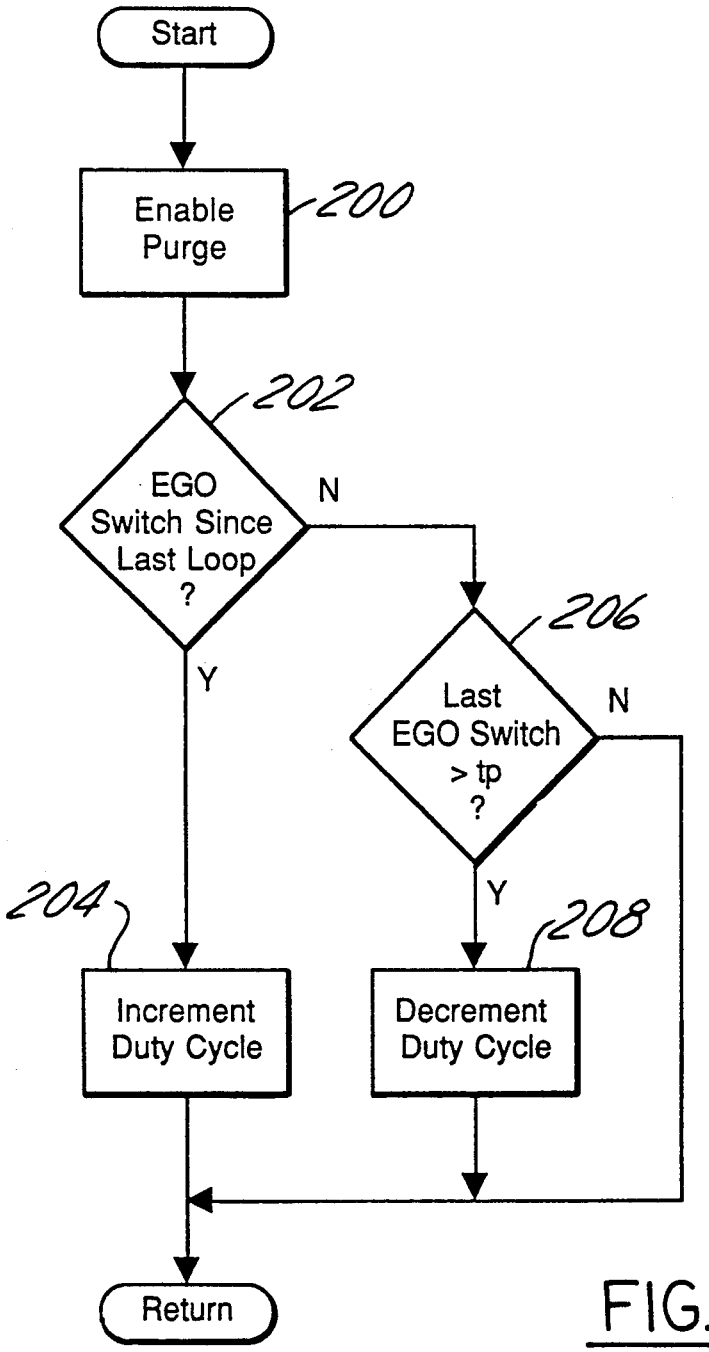
FIG. 3 is a high level flowchart illustrating steps performed by a portion of the embodiment illustrated in FIG. 1.
Figure 4:
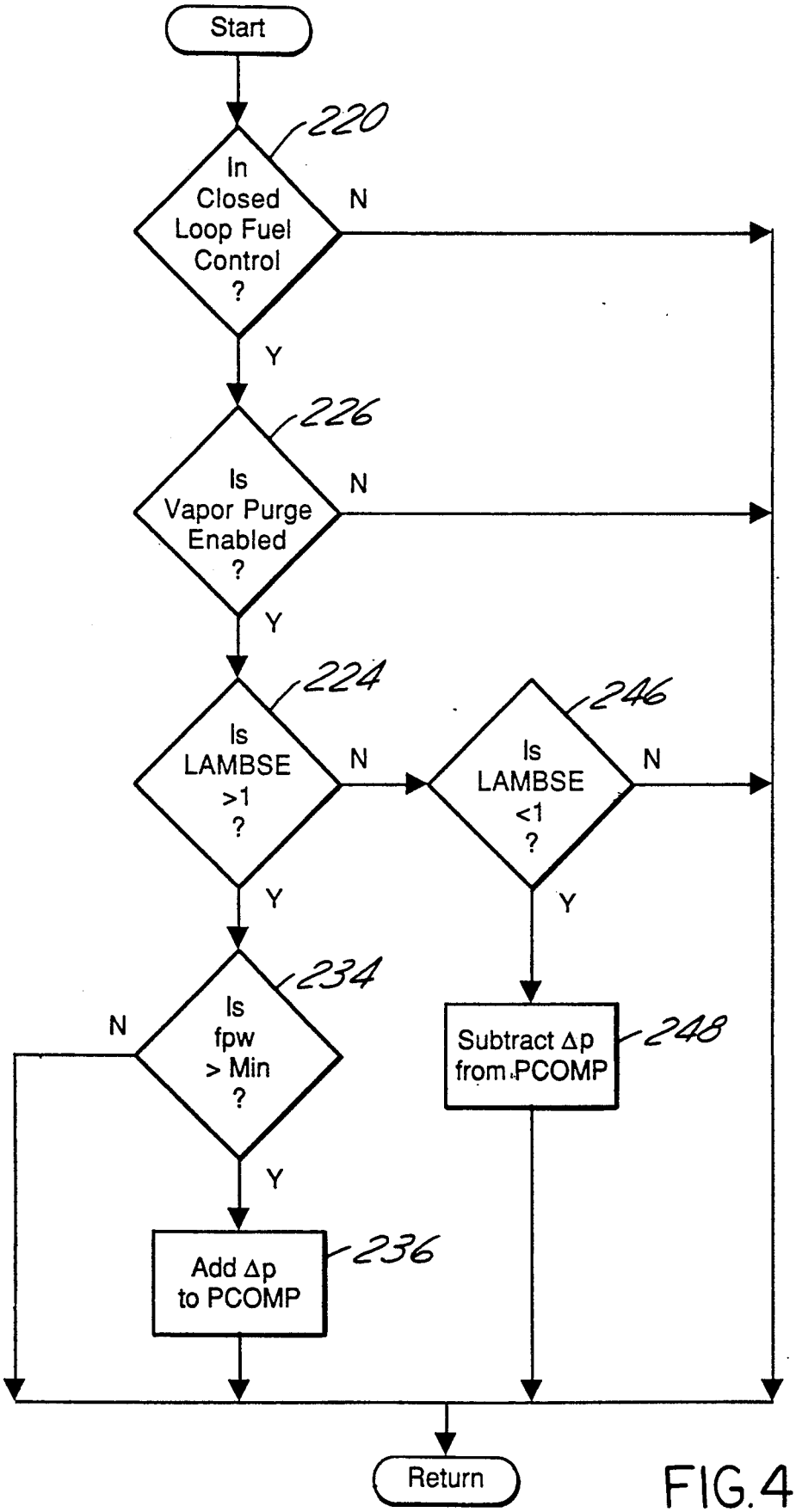
FIG. 4 is a high level flowchart illustrating steps performed by a portion of the embodiment illustrated in FIG. 1.

Operation of vapor purge controller 28 and vapor learning controller 40 are now described with reference to FIGS. 3 and 4, respectively, and continuing reference to FIG. 1. The operational steps performed by vapor purge controller 28 are first described with particular reference to FIG. 3. During step 200, vapor purge operations are enabled in response to engine operating parameters such as engine temperature. Thereafter, the duty cycle of signal ppw, which actuates purge valve 78, is incremented a predetermined time when EGO sensor 26 has switched states since the last program background loop (see steps 202 and 204). If there has not been a switch in states of EGO sensor 26 during predetermined time tp, such as two seconds, the purge duty cycle is decremented by a predetermined amount (see steps 202, 206, and 208).

In accordance with the above described operation of vapor purge controller 28, the rate of vapor flow is gradually increased with each change in state of EGO sensor 26. In this manner, vapor flow is turned on at a gradual rate to its maximum value (typically 100% duty cycle) when indications (i.e., EGO switching) are provided that PI controller 32 and vapor recovery learning controller 40 are properly compensating for purging of fuel vapors.

The operation of vapor recovery learning controller 40 is now described with reference to process steps shown in FIG. 4. When controller 10 is in closed loop or feedback air/fuel control (step 220), and vapor purge is enabled (step 226), LAMBSE is compared to its reference or nominal value, which is unity in this particular example. If LAMBSE is greater than unity (step 224), indicating a lean fuel correction is being provided, and fuel pulse width signal fpw is greater than its minimum value (step 234), signal PCOMP is incremented by integration value Δp during step 236. The liquid fuel delivered is therefore decreased, or leaned, by Δp each sample time when LAMBSE is greater than unity. This process of integrating continues until LAMBSE is forced back to unity.

When LAMBSE is less than unity (step 246) integral value Δp is subtracted from PCOMP during step 248. Delivery of liquid fuel is thereby increased and LAMBSE is again forced towards unity.

In accordance with the above described operation, vapor recovery learning controller 40 adaptively learns the mass flow rate of recovered fuel vapors. Delivery of liquid fuel is corrected by this learned value (PCOMP) to maintain stoichiometric combustion while fuel vapors are recovered or purged.

The learning process described above is inhibited when a lean fuel correction is provided by LAMBSE (step 224) and there is an indication of a rich air/fuel offset caused by a condition other than vapor purging. In this particular example, that offset indication is provided when the fuel pulse width is less than a minimum value (step 234). Such a condition may occur, for example, during deceleration when the fuel injector may not be capable of accurately delivering a sufficiently small quantity of fuel to maintain stoichiometry. Engine 14 will therefore run rich and the process of inhibiting integration will prevent the erroneous learning of such rich offset.

This concludes the description of the preferred embodiment. The reading of it by those skilled in the art will bring to mind many alterations and modifications without departing from the spirit and scope of the invention. For example, LAMBSE may trim the base fuel quantity by providing a multiplicative factor in which case the output polarities of the EGO sensor would be reversed. Further, although a proportional plus integral feedback controller is shown, other feedback controllers may be used to advantage such as a pure integral controller or a derivative plus integral controller. Accordingly, it is intended that the scope of the invention be limited only by the following claims.

What is claimed:

1. A control system for controlling a fuel injected internal combustion engine, comprising:

feedback control means for providing a feedback signal by integrating a signal responsive to an exhaust gas oxygen sensor;

actuation means for providing an actuating signal to at least one fuel injector with a pulse width related to said feedback signal; and inhibiting means for inhibiting integration of said signal by said feedback control means when said pulse width is less than a predetermined pulse width.

2. The control system recited in claim 1 wherein said inhibiting means inhibits integration of said signal by said feedback control means when said pulse width is less than said predetermined pulse width and said signal responsive to said exhaust gas oxygen sensor is at a value which decreases fuel to the engine.

3. The control system recited in claim 1 wherein said feedback means provides said feedback signal by adding a constant value to said integration of said signal whenever said output state of said signal changes states.

4. A control system for controlling a fuel injected internal combustion engine, comprising:

an exhaust gas oxygen sensor with an output signal having a first output state when combustion gases are rich of stoichiometric combustion and a second output state when combustion gases are lean of stoichiometric combustion;

actuation means for providing an electrical actuating signal to at least one fuel injector with a pulse width related to amplitude of a feedback signal derived from said output signal;

feedback means for integrating said output signal to provide said feedback signal with said amplitude increasing in a direction which decreases said actuating signal pulse width while said output signal is in said first output state, said feedback means providing said feedback signal with said amplitude increasing in a direction which increases said actuating signal pulse width while said output signal is in said second output state; and inhibiting means for inhibiting further increases in said amplitude of said feedback signal in said direction which decreases said actuating signal pulse width when said pulse width is less than a minimum value and said output signal is in said first output state.

5. The control system recited in claim 4 wherein said actuating means provides said actuating signal by dividing a measurement of inducted airflow by both said feedback signal amplitude and a reference air/fuel ratio.

6. The control system recited in claim 4 wherein said feedback means provides said feedback signal by adding said integration of said output signal to a product of a gain value times said output state of said output signal.

7. A control system for controlling a fuel injected internal combustion engine having a fuel vapor recovery system coupled between a fuel system and an air/fuel intake of the engine, comprising:

first feedback control means for providing a first feedback signal by integrating a signal responsive to an exhaust gas oxygen sensor coupled to the engine exhaust;

second feedback control means for providing a second feedback signal related to inducted quantity of the recovered fuel vapors by generating a difference between said first feedback signal from a reference associated with stoichiometric combustion and integrating said difference;

actuation means for providing an actuating signal to at least one fuel injector with a pulse width related to both airflow inducted into the engine and said first feedback signal and said second feedback signal; and inhibiting means for inhibiting integration of said signal by said feedback control means when said pulse width is less than a predetermined pulse width.

8. The control system recited in claim 7 wherein said inhibiting means inhibits integration of said signal when said pulse width is less than a predetermined pulse width and said first feedback signal is at a value which decreases fuel delivered to the engine.

9. The control system recited in claim 7 wherein said reference associated with stoichiometric combustion is unity.

10. The control system recited in claim 7 wherein said first feedback signal is related to variation in the inducted mixture of air and injected fuel from stoichiometry.

* * * * *